United States Patent [19]

Iwai

[11] Patent Number: 4,815,670

[45] Date of Patent: Mar. 28, 1989

[54] SHREDDER

[75] Inventor: Shougo Iwai, Nara, Japan

[73] Assignee: Sharp Kabushiki Kaisha, Osaka, Japan

[21] Appl. No.: 103,839

[22] Filed: Oct. 1, 1987

[30] Foreign Application Priority Data

Oct. 2, 1986 [JP] Japan ..... 61-235979

[51] Int. Cl.[4] ..... B02C 25/00

[52] U.S. Cl. ..... 241/34; 241/100; 241/223; 241/225; 271/35; 271/259

[58] Field of Search ..... 271/9, 35, 258, 259, 271/198, 902; 241/100, 34, 35, 236, 235, 224, 225, 223, 101 D

[56] References Cited

U.S. PATENT DOCUMENTS 4,192,467 3/1980 Hatanaka ..... 241/34

4,231,530 11/1980 Hatanaka ..... 241/223

FOREIGN PATENT DOCUMENTS 2238778 3/1973 Fed. Rep. of Germany ..... 241/236

3313232 10/1984 Fed. Rep. of Germany ..... 241/236

2394326 2/1979 France ..... 241/236

*Primary Examiner*—Mark Rosenbaum

*Attorney, Agent, or Firm*—Flehr, Hohbach, Test, Albritton & Herbert

[57] ABSTRACT

A shredder has two intake sections through which paper to be shredded can be fed through cutting rollers. Detectors for detecting presence or absence of paper in each sections are provided such that the maximum number of sheets of paper that can be transported through the first intake section to the cutting rollers is changed, depending on whether presence of paper is detected also in the second intake section or not.

4 Claims, 3 Drawing Sheets

SHREDDER

BACKGROUND OF THE INVENTION

This invention relates to a shredder and more particularly to the control of rate at which documents are supplied to a shredder.

Prior art shredders are provided with only one intake section for accepting documents to be shredded. If it happens that a certain document must be shredded immediately while such a shredder is in the midst of shredding a large number of documents continuously, the operator must either interrupt the job currently in progress and start the more urgent shredding job or wait until the job in progress is completed and then start the required urgent job, and there is a loss of time in either way. If the person in possession of such a document decides to leave it with the operator, asking the operator to shred it as soon as the job in progress is completed, there is the danger of the secret leaking in the meantime. On the other hand, it is not economical from the point of view both of cost and of space to provide more than one shredder. In view of this disadvantage of prior art shredders, the present applicant has previously considered a shredder having a plurality of intake sections as disclosed in Japanese Patent Application No. 61-105878. According to an embodiment of the technology disclosed therein, the cutter rollers have the capability of shredding 22 sheets and the numbers of sheets supplied through the first and second intake sections are controlled to be 15 or less and 7 or less, respectively. Thus, even if documents are transported simultaneously through the two intake sections, no more than 22 sheets of paper will be supplied to the cutter rollers simultaneously in excess of their capability and all sheets that are supplied are successfully shredded. A shredder thus controlled, however, is not efficient if only one of the intake sections is used to feed documents because no more than 15 sheets are actually shredded although the cutter rollers are capable of shredding up to 22 sheets.

SUMMARY OF THE INVENTION

It is therefor an object of the present invention to provide an efficient shredder having a plurality of intake sections.

It is another object of the present invention to provide a shredder as described above which is further capable of controlling the number of sheets to be transported to the cutter rollers through one of the intake sections according to whether or not sheets of paper are also being fed through the other intake section such that documents are always transported to the cutter rollers at a maximum rate.

The above and other objects of the present invention are achieved by providing a shredder comprising cutting rollers, two (first and second) intake sections through which paper to be shredded is to be supplied to the cutting rollers, means provided to the intake sections for regulating the numbers of transported sheets, means for adjusting the rate at which paper is fed by the regulating means of the first intake section, detectors for detecting the presence or absence of paper in the intake sections and a control unit for controlling the adjusting means according to the signals received from these detectors. The control unit is adapted to output a signal for passing a smaller amount of paper if a signal indicative of the presence of paper in the second intake section is received and a signal for passing a larger amount of paper if a signal indicative of the absence of paper in the second intake section is received.

When documents are being fed only through the first intake section of a shredder thus structured, a signal indicative of absence of paper in the second intake section is transmitted and up to 22 sheets of paper are supplied through the first intake section. If paper is supplied through both the first and second intake sections, a different signal indicative of the presence of paper in the second intake section is transmitted and no more than 17 sheets of paper are supplied through the first intake section. Thus, if a document needed to be shredded urgently is fed through the second intake section while documents from the first intake section are being continuously shredded, the rate of supply through the first intake section becomes reduced and the shredder can start shredding the important documents immediately without interrupting the job in progress.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
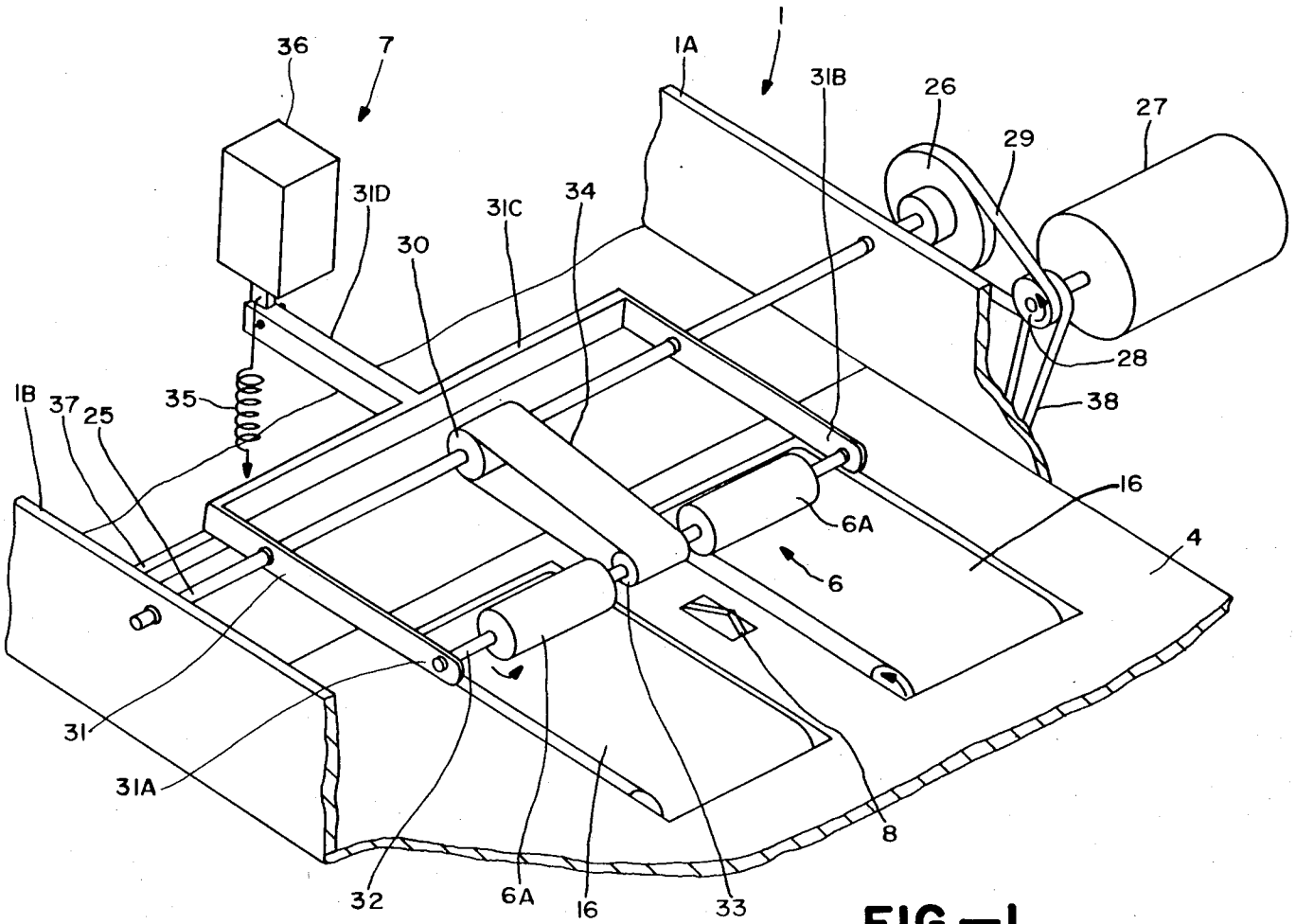
FIG. 1 is a diagonal view of the first intake section of a shredder according to the present invention.
Figure 2:
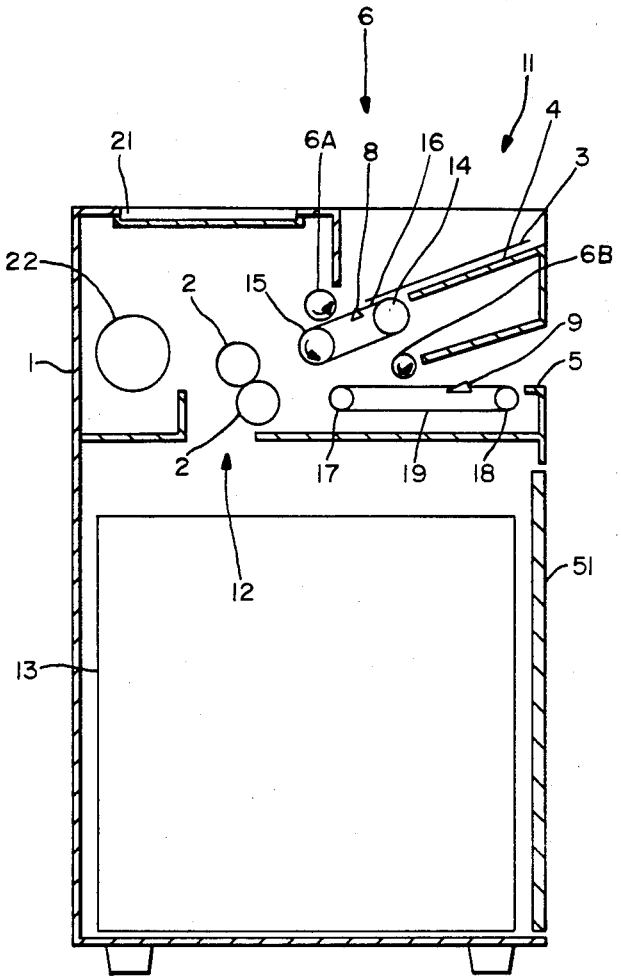
FIG. 2 is a schematic sectional view of the shredder of which the first intake section is shown in FIG. 1.

With reference to the figures, numeral 1 indicates a shredder housing which contains cutting rollers 2 disposed at an upper part, a first intake section 4 and a second intake section 5 for transporting paper to be shredded 3 to the cutting rollers 2, regulating means 6 provided to the first and second intake sections 4 and 5 for regulating the numbers of paper to be transported therethrough, adjusting means 7 for adjusting the rate at which paper is fed by the regulating means 6 for the first intake section 4, detectors 8 and 9 for determining whether paper is present or absent in the first intake section 4 and the second intake section 5, respectively, and a control unit 10 for controlling the adjusting means 7 according to signals received from the detectors 8 and 9. If the detector for the second intake section 5 transmits a signal indicative of the presence of paper in the second intake section 5, the control unit 10 transmits a signal to feed paper through the first intake section 4 at an increased rate. If the detector 9 transmits a different signal indicative of the absence of paper in the second intake section 5, the control unit 10 transmits a signal to feed paper through the first intake section 4 at a reduced rate.

Figure 4:
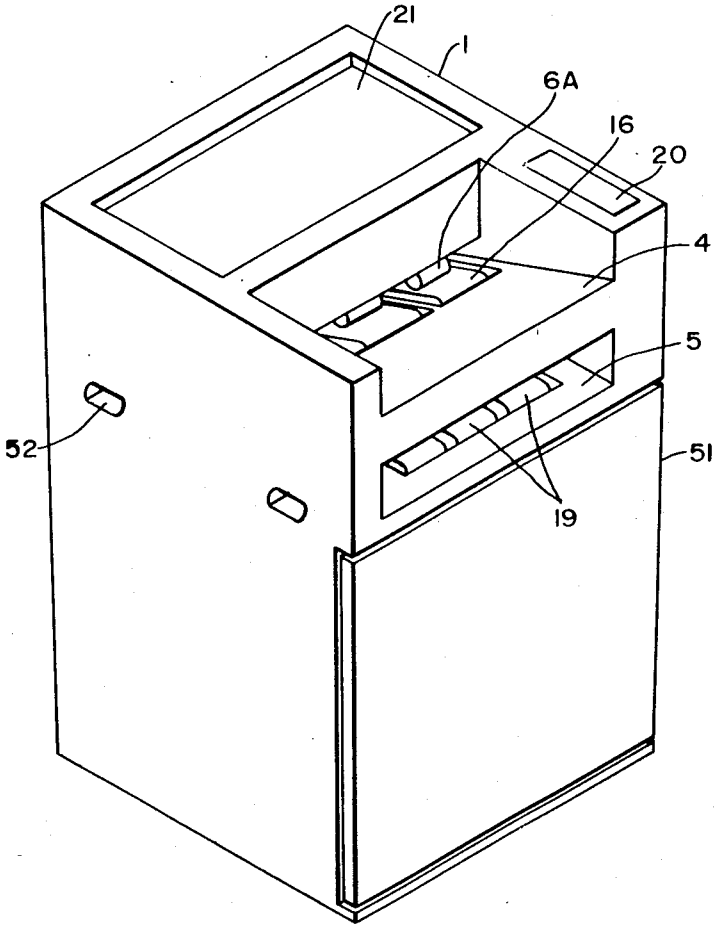
FIG. 4 is a perspective external view of the shredder of FIG. 2.

The shredder is composed of a paper feeder section 11 for feeding paper 3, a shredding section 12 where the paper 3 transported from the feeder section 11 is shredded, and a trash box 13 for receiving and storing the paper 3 shredded in the shredding section 12. The paper feeder section 11 includes the first intake section 4, the second intake section 5 below the first intake section 4, a conveyer belt 16 stretched over rollers 14 and 15 for transporting paper 3 from the first intake section 4 to the cutting rollers 2, reverse rollers 6A as a part of the aforementioned regulating means 6 to regulate the number of sheets of paper transported by this conveyer belt 16, the first detector 8 for detecting the presence of paper in the first intake section 4, another conveyer belt 19 stretched over another set of rollers 17 and 18 for transporting paper set in the second intake section 5, and another set of reverse rollers **6*b* as another part of the aforementioned regulating means 6 to regulate the amount of paper transported by this conveyer belt 19 and the second detector 9 for detecting the presence of paper in the second intake section 5. As shown in FIG. 4, the top surface of the housing 11 is provided with a control panel 20 and a table 21 for setting paper which cannot fit in the first and second intake sections 4 and 5. The shredding section 12 including the cutting rollers 2 capable of shredding about 22 sheets of paper of 50 $g/m^2$ and a motor 22** for driving them.

In the second intake section 5, the separation between the conveyer belts 19 and the reverse rollers 6B are so adjusted that no more than 5 sheets of paper to be shredded will be passed to the cutting rollers 2. This separation is fixed and not variable. In the first intake section 4, by contrast, the separation between the conveyer belts 16 and the reverse rollers 6A are adjustable such that the aforementioned regulating means 7 can set this separation so as to allow up to 22 sheets or up to 17 sheets of paper to pass therethrough. The regulating means 7 include, as shown in FIG. 1, a first rotary axis 25 rotatably supported through bearings by chassis 1A and 1B affixed to the main body, a first pulley 26 attached to one end of the first rotary axis 25, a second pulley 28 affixed to the drive shaft of a motor 27 and a belt 29 stretched over the first and second pulleys 26 and 28. A first transmission roller 30 is affixed to the first rotary axis 25 nearly at its midpoint and an arm 31 which is U-shaped when seen from above is rotatably attached to the first rotary axis 25 through bearings. A second rotary axis 32, to which the reverse rollers 6A and a second transmission roller 33 are affixed, is attached to end sections 31A and 31B of the arm 31 through bearings and a belt 34 is stretched over the two transmission rollers 30 and 33 to transmit rotary power therebetween.

Attached to the center section 31C of the U-shaped arm 31 is a switching arm 31D which protrudes therefrom in the direction opposite to the end sections 31A and 31B and this switching arm 31D is provided with a spring 35 for applying a downward biasing force thereon and a solenoid 36 for moving the switching arm 31D upward against the biasing force of the spring 35. They are so adjusted with respect to each other that when the solenoid 36 is not activated, the elastic force of the spring 35 causes the center section 31C of the arm 31 to rest in contact with a stopper 37 and the separating distance between the reverse rollers 6A and the conveyer belts 16 is such that no more than 22 sheets of paper can be supplied therethrough but when the solenoid 36 is activated, the switching arm 31D is moved upward to rotate the U-shaped arm 31 and the separating distance between the reverse rollers 6A and the conveyer belts 16 becomes such that only up to 17 sheets of paper can pass therethrough. In other words, the rate at which paper is supplied through the first intake section 4 can be reduced by activating the solenoid 36. Numeral 38 in FIG. 1 indicates another transmission belt for transmitting the driving power of the motor 27 to the conveyer belts 16 such that the counterclockwise rotation of the motor 27 as shown by an arrow on the pulley 28 causes the reverse rollers 6A to turn opposite to the direction in which paper is transported by the conveyer belt 16. In FIG. 4 numeral 51 indicates a front door for the trash box 13 and numeral 52 indicates handles for moving the shredder.

Figure 3:
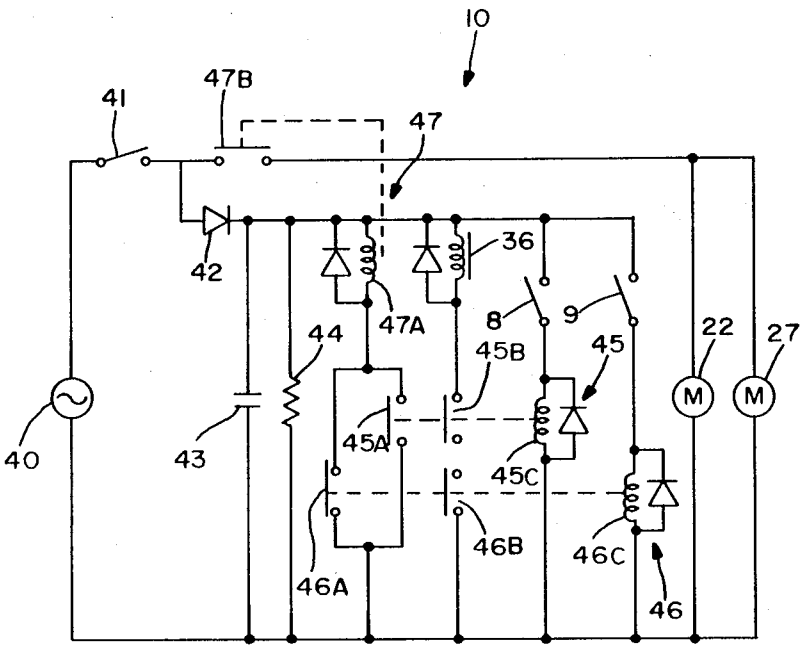
FIG. 3 is a circuit diagram of the control circuit for the shredder of FIG. 2.

The control unit 10 includes as shown in FIG. 3 a regulating circuit which is connected through a power switch 41 to an AC source 40 and is composed of a diode 42, a capacitor 43, and a resister 44. Also connected to this regulating circuit are a first relay 45, a second relay 46 and a third relay 47 which switch on and off depending on the outputs from the detectors 8 and 9 indicating presence or absence of paper in the first and second intake sections 4 and 5. The first and second relays 45 and 46 each include two normally-open junctions 45A, 45B, 46A and 46B, the first junctions 45A and 46A of the first and second relays 45 and 46 being connected in parallel with respect to each other and this parallel connection being connected in series to the coil 47A of the third relay 47. The second junctions 45B and 46B of the first and second relays 45 and 46 are connected in series to the coil of the aforementioned solenoid 36. The coil 45C of the first relay 45 is connected in series to the first detector 8 and the coil **46*c* of the second relay 46 is connected in series to the second detector 9. The normally-open junction 47B of the third relay 47 is connected in series to the power switch 41 and to the parallel connection of the motors 22 and 27**.

In the mode of operation wherein only the first intake section 4 is used to throw documents into the shredder, a DC voltage is obtained by the diode 42, the capacitor 43 and the resister 44 when the power switch 41 is closed and when paper 3 is detected by the detector 8 in the first intake section 4, the coil 45C of the first relay 45 is activated to close the normally-open junctions 45A and 45B. This causes the coil 47A of the third relay 47 to be activated and the normally-open junction 47B is closed, the motors 22 and 27 begin to rotate and the shredding operation is started. In the meantime, the second detector 9 is in the OFF condition, indicating the absence of paper in the second intake section 5 and since the solenoid 36 is not activated, the arm 31 of the regulating means 7 remains in the downwardly pulled condition around the first rotary axis 25 such that the reverse rollers 6A assume the upward position and up to 22 sheets of document paper can be passed through them and the conveyer belts 16.

Similarly, if only the second intake section 4 is used to feed documents to be shredded, the second detector of the second intake section 5 is switched on but the first detector remains in the OFF condition such that the coil 46C of the second relay 46 is activated and the normally-open junctions 46A and 46B are closed, causing the third relay 47 to be activated and driving the motors 22 and 27 as in the mode of operation described above wherein only the first intake section 4 is used.

When both the first and second intake sections 4 and 5 are used to feed documents to the cutting rollers 2, both detectors 8 and 9 are switched on. The normally-open junctions 45B and 46B are switched on and the solenoid 36 is activated. As a result, the arm 31 of the regulating means 7 is rotated around the first rotary axis 25 and the distance between the reverse rollers 6A and the conveyer belts 16 becomes reduced so that only 17 sheets of paper 3 can pass therebetween. In the meantime, the normally-open junction 47B of the third relay 47 is closed, causing the motors 22 and 27 to rotate.

In summary, up to 22 sheets of paper to be shredded can be fed when only one of the two intake sections 4 and 5 is used, but the shredder is automatically adjusted such that up to only 17 sheets of paper can be fed through the first intake section 4 if documents are fed through both sections 4 and 5. In other words, if a new batch of documents is fed into the second intake section 5 while documents are being fed continuously through the first intake section 4 at the maximum rate according to the capability of the cutting rollers 2, the first intake section 4 begins to feed at a reduced rate such that the new batch can be processed immediately without interrupting the shredding job which has been in progress.

The foregoing description of a preferred embodiment of the invention has been presented for purposes of illustration and description. It is not intended to be exhaustive or to limit the invention to the precise form disclosed, and many modifications and variations are possible in light of the above teaching. Any modifications and variations which may be apparent to a person skilled in the art are intended to be included within the scope of this invention.

What is claimed is:

1. A shredder comprising cutting rollers disposed inside a housing, a first intake section and a second intake section from which documents to be shredded can be fed to said cutting rollers, regulating means for regulating the rates at which paper to be shredded is transported through said intake sections, adjusting means for adjusting said rates regulated by said regulating means, detectors for detecting and outputting signals indicative of presence or absence of paper in said first and second intake sections, and a control unit for controlling said adjusting means according to said signals from said detectors.

2. The shredder of claim 1 wherein said regulating means include conveyer belts for transporting paper to be shredded and rollers disposed adjacent to and at an adjustable distance from said conveyer belts to pass a specified amount of paper therebetween.

3. The shredder of claim 2 wherein said rollers are adapted to rotate against the motion of said conveyer belts.

4. The shredder of claim 2 wherein said adjusting means include a spring for applying a biasing force on said rollers and a solenoid for applying a force against said biasing force when activated.

* * * * *